United States Patent [19]

Schulz

[11] Patent Number: 4,524,251

[45] Date of Patent: Jun. 18, 1985

[54] ELECTRICAL SWITCH

[75] Inventor: Siegfried Schulz, Hueckeswagen, Fed. Rep. of Germany

[73] Assignee: K. A. Schmersal GmbH & Co., Fed. Rep. of Germany

[21] Appl. No.: 553,039

[22] Filed: Nov. 18, 1983

[30] Foreign Application Priority Data

Aug. 20, 1983 [DE] Fed. Rep. of Germany ..... 3330109

[51] Int. Cl.[3] ..... H01H 13/52; H01H 9/28

[52] U.S. Cl. ..... 200/42 R; 200/302.2; 200/340

[58] Field of Search ..... 200/42 R, 44, 153 L, 200/302.2, 61.59, 47, 340

[56] References Cited

U.S. PATENT DOCUMENTS 4,395,608 7/1983 Eicker et al. ..... 200/153 L

FOREIGN PATENT DOCUMENTS 3112097 10/1982 Fed. Rep. of Germany .... 200/42 R 847851 9/1960 United Kingdom ..... 200/42 T

*Primary Examiner*—John W. Shepperd

*Attorney, Agent, or Firm*—Orrin M. Haugen; Thomas J. Nikolai; Douglas L. Tschida

[57] ABSTRACT

An electrical switch for use as a safety switch for doors of lifts or elevators, the contact push rod of which is actuated by a switching roller when the roller is turned by means of an inserted actuating member. The switching roller comprises two axially spreadable switching roller portions that can be spread against the force of a spring by a pin specially provided for that purpose on the actuating member; if there is no pin on the actuating member, the roller strikes a stop before the switch is closed.

12 Claims, 5 Drawing Figures

ELECTRICAL SWITCH

BACKGROUND OF THE INVENTION

The invention relates generally to a safety keyed electrical switch having at least one axially displaceable roller coupled to an orthogonally mounted contact containing push rod. A commercially available switch of this type is designed in such a manner that the roller is coupled via a connecting rod to the push rod. Provided at the side of the roller and rotatable about the same axis are catches which can be pivoted into the release position by the free ends of an approximately "H"-shaped actuating member, but, when using a simple tool, for example, a wire bent in a "U"-shape, they block the actuation of the switch.

In addition, U.S. Pat. No. 4,395,608 and its German counterpart Pat. No. DE-OS 31 00 862 discloses an electrical switch in the case of which a roller is coupled via a connecting link guide to the push rod. The connecting link guide is in mirror-symmetrical form so that the roller, starting from a central rest position, can move the push rod, when rotated in either direction by means of a "U"-shaped actuating member; in this manner it is possible, for example, to provide three possible operating orientations, which affords the user a high degree of flexibility when constructing his installations.

Since, in the case of known switch described at the beginning, the catches are designed asymmetrically, it is not possible to transfer this additional "coding", which is, however, desirable for safety reasons, to the type of switch last described.

The problem underlying the invention is to provide a "coding possibility" that can be used for switches of the type last mentioned and that can be realized with a small number of components and a small space requirement.

The solution according to the invention is defined in the following claim 1.

Further advantageous forms of the invention are indicated in the sub-claims, the importance of the individual features being made clear from the following detailed description.

A preferred embodiment of the subject of the invention is explained in detail below with reference to the attached drawings.

IN THE DRAWINGS

DESCRIPTION OF THE PREFERRED EMBODIMENT

Figure 2:
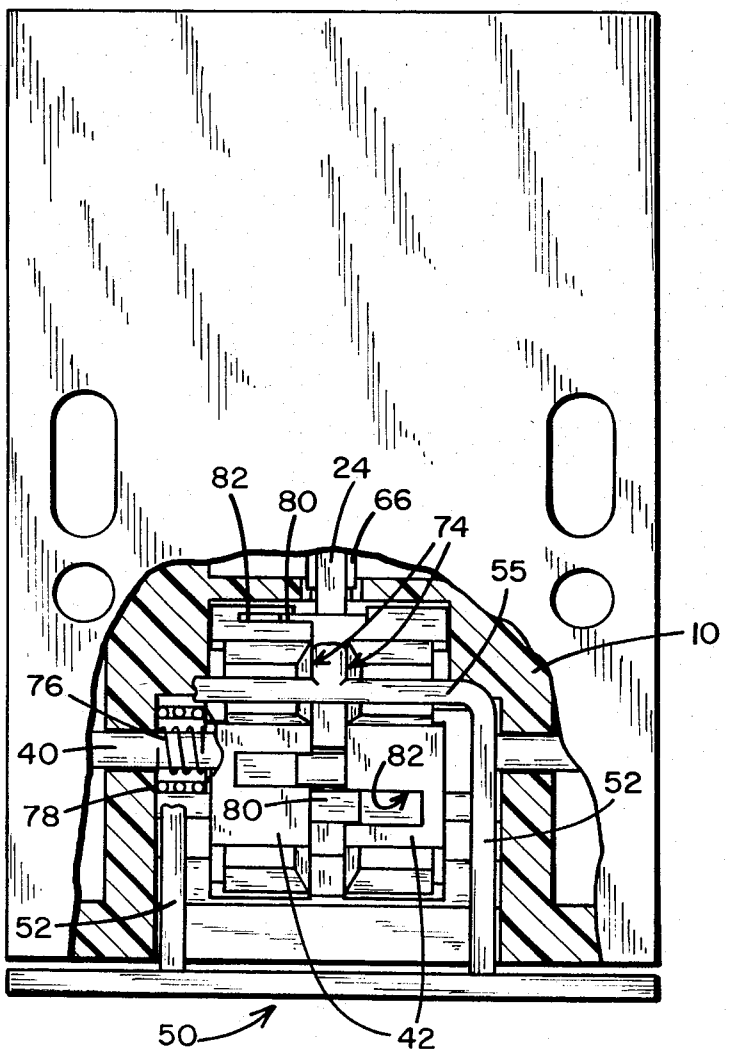
FIG. 2 is a view, partly in section, of the switch according to FIG. 1 in an axial plane of the roller.
Figure 1:
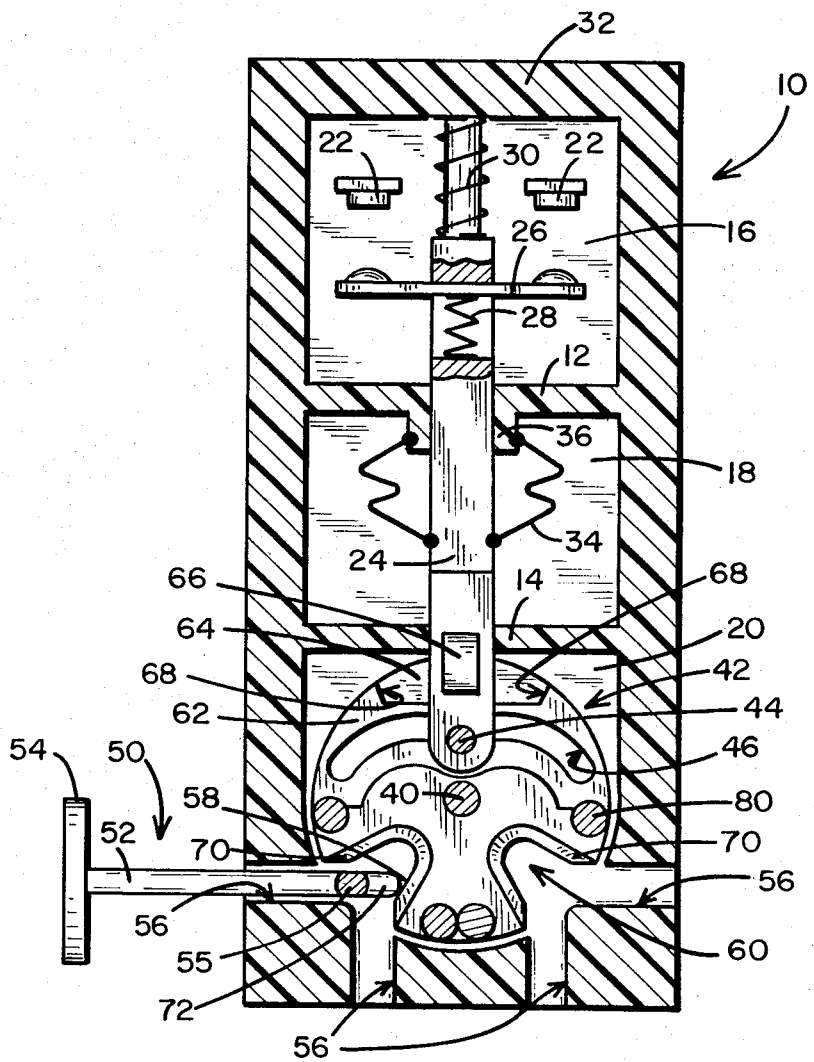
FIG. 1 is a largely diagrammatic longitudinal section, perpendicular to the axis of the roller, through a switch according to the invention.

Referring to FIGS. 1 and 2, the housing 10 of the switch is divided by transverse walls 12 and 14 into a contact chamber 16, a sealing chamber 18 and a roller chamber 20. The connection contacts 22 are mounted in a fixed manner in the contact chamber 16. A push rod 24 carries a contact bridge 26 which, in the closed position of the switch, connects the connection contacts 22; a compression spring 28 is supported in a recess crossed by the bridge 26 and brings about the necessary contact pressure when the switch is closed. A further compression spring 30 is stressed between the end wall 32 of the housing and the opposed end of the push rod 24 and aids the return of the push rod 24 to the position associated with the opening of the switch.

The push rod 24 is guided in a straight line in the transverse walls 12 and 14. On the side of the transverse wall 12 remote from the contact chamber, sealing bellows 34 cooperate on the one hand with an extension 36 of this transverse wall and, on the other hand, with the push rod 24 in order to seal off the contact chamber from the outside atmosphere.

In the roller chamber 20, two roller portions 42 are rotatably mounted on a shaft 40. In order for the push rod 24 to be moved against the action of the spring 30 by a rotation of the rollers 42, it has a cam follower pin 44 engaged in cam paths 46 which are recessed in the opposed surfaces of the roller portions. The cam paths are in the form an elongate "3" and when the rollers turn in either direction, starting from the rest position shown in FIG. 1, the push rod 24 is moved in the direction that brings about the closure of the switch.

Figure 4:
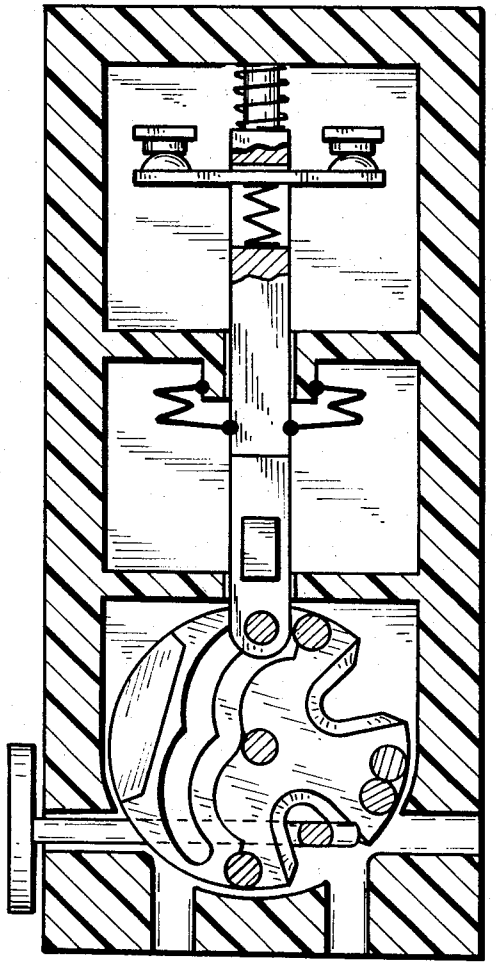
FIGS. 3 and 4 are views similar to FIG. 1 of the end positions of the roller and the push rod in the case of operation with an incorrect and correct actuating member, respectively.
Figure 3:
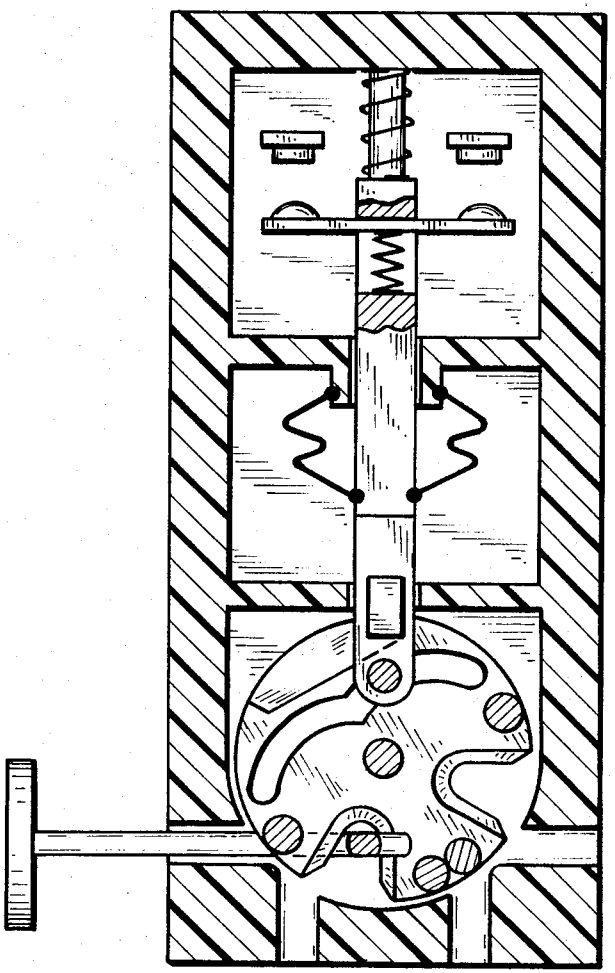

The actuating member 50 is in principle a "U"-shaped wire, the free arms 52 of which are fastened, for example, to a flap 54 while the transverse arm 55 can pass through one of the four housing openings 56 and strike the wall 58 of one of the two radial slots 60 in the roller portions thereby turning them (see also FIGS. 3 and 4).

As long as only this transverse arm 55 strikes the roller portions 42, however, the switch cannot be actuated fully since the roller portions 42 have in addition, in the region 62, where they lie at the side of the push rod 24 and therefore have a correspondingly reduced thickness, a cutaway portion 64 into which projects in each case one extension 66 formed on the push rod 24. When the roller portions 42 rotate, one of the end edges 68 of the cutaway portion strikes this extension (see FIG. 3) if the roller portions 42 are not displaced away from the push rod 24 in the axial direction. This is not possible with a simple stirrup piece, as shown in FIG. 3.

This is, however, made possible according to the invention by a bevel 70, acting as a wedge surface, of the opposed edges of the radial slots 60 against which runs a pin-like extension 72 which projects outwards from the transverse arm in the separating plane of the two roller portions 42, generally aligned with the central plane of the housing openings 56. The sides 74 of this extension push the two roller portions 42 outwards against the force of, in each case, one compression spring 76 which is guided in such a narrow path between the shaft 40 and a sleeve-shaped flange 78 formed on the particular roller portion 42 that a restoring force is still developed even if the spring 76 is fractured. The other end of the spring 76 is supported against the housing 10.

The two roller portions 42 are of identical design and are fabricated as pressed or plastic injection-moulded parts. They have axially directed projections 80 which engage in complementary recesses 82 in the other roller portion so that the two roller portions are nonrotatably coupled to one another without hindrance to their axial displaceability.

Figure 5:
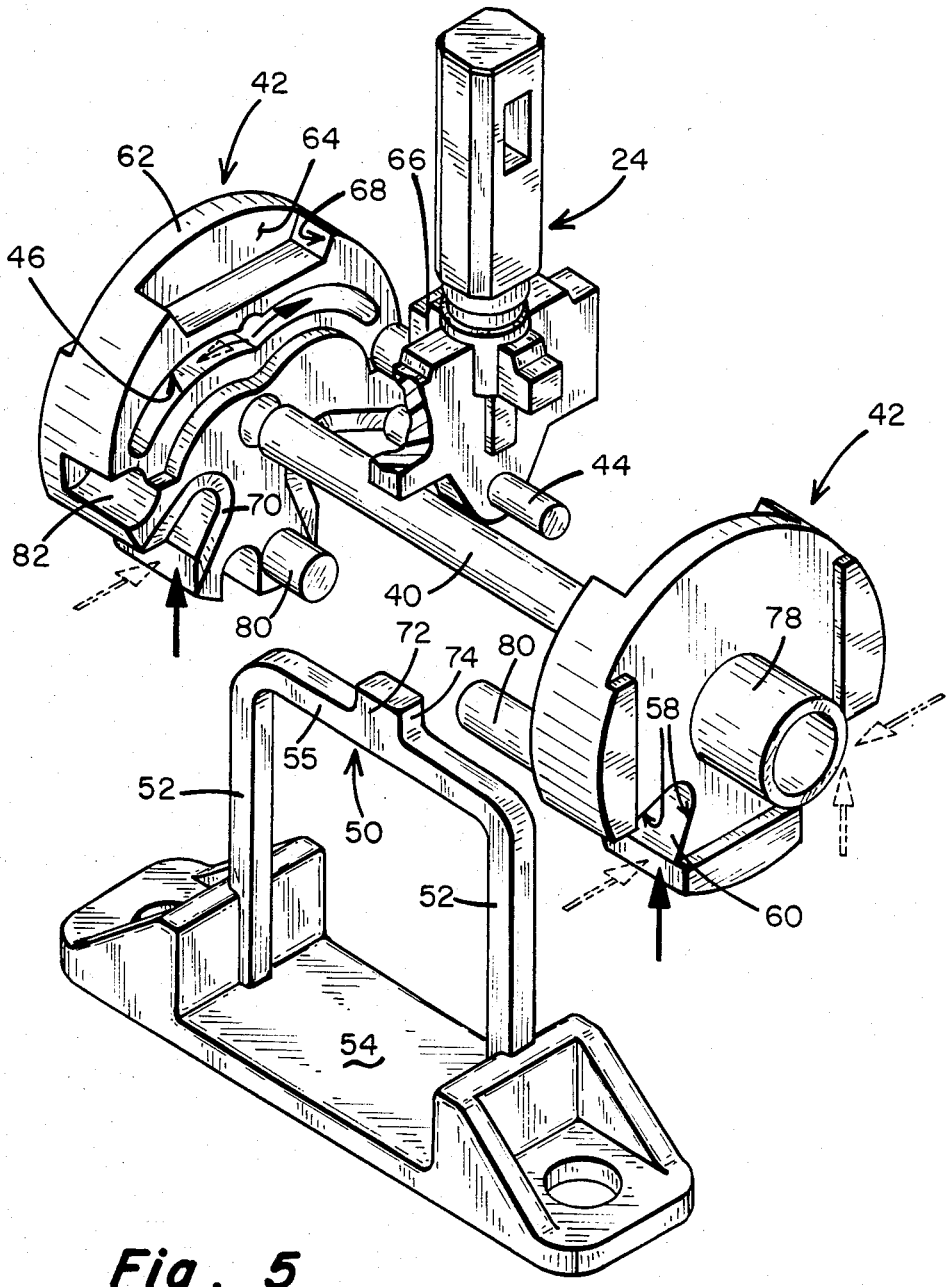
FIG. 5 is a perspective view of the actuating system.

FIG. 5 shows, once again, the functional parts on a larger scale in a perspective exploded view.

I claim:

1. A keyed electrical switch comprising:

(a) a housing containing a slidably mounted push rod, said push rod including one or more electrical contacts for engagement with one or more electrical contacts mounted along a path of travel of said push rod;

(b) a switch actuating member insertable through a mating opening in said housing;

(c) at least one roller mounted in said housing to rotate upon engagement by said actuating member;

(d) means engageable by said actuating member for displacing said roller along its axis of rotation and including means for limiting the rotation of said roller, unless said roller is axially displaced; and (e) means coupling said roller to said push rod for actuating said push rod to make or break one or more electrical connections between one or more of said electrical contacts at a predetermined pivot angle of said roller occurring when said roller is axially displaced.

2. An electrical switch as set forth in claim 1 wherein said rotation limiting means comprises at least one member that extends from said push rod and interlocks with a mating portion of said roller over a limited portion of said roller's path of travel. actuating member.

3. An electrical switch as set forth in claim 1 wherein said switch actuating member includes a beveled portion transversely overlapping in the direction of insertion with a complementary beveled portion on said roller, thereby facilitating the lateral displacement of said roller along its axis of rotation.

4. An electrical switch as set forth in claim 1 including means for urging said roller towards its undisplaced condition and whereby said roller is returned thereto upon disengaging said actuating member from said lateral displacement means.

5. An electrical switch as set forth in claim 1 wherein said switches includes a pair of rollers mounted on opposite sides of said push rod within said housing and also includes means for interlocking said rollers with each other so as to operate in unison relative to said actuating member and said push rod.

6. An electrical switch as set forth in claim 1 wherein said actuating member comprises a "U"-shaped member having a projection extending therefrom and which projection, upon inserting said member into said housing engages said displacement means and axially displaces said roller, thereby permitting said roller to rotate and move said push rod upon the further engagement of said roller by one or more portions of said actuating member.

7. An electrical switch as set forth in claim 1 wherein said push rod actuating means comprises a projection extending from said push rod in mating relation with an arcuate recess formed in a surface of said roller such that as said roller rotates said projection follows said recess and linearly actuates said push rod.

8. An electrical switch as set forth in claim 1 wherein said housing includes a pair of switch actuating member receiving openings and said switch is operable upon inserting said switch actuating member into either of said openings.

9. An electrical switch including:

(a) a switch housing containing a slidably mounted pusher member having one or more electrical contacts mounted thereto for engagement with one or more electrical contacts mounted within said switch housing along the path of travel of said pusher member;

(b) first and second rollers rotatively mounted within said housing so as to rotate in unison on a common axis of rotation on opposite sides of said pusher member;

(c) a switch actuating member insertable through either of a first or second mating opening in said switch housing;

(d) means engageable by said actuating member for laterally displacing said first and second rollers along their axes of rotation;

(e) means for limiting the rotation of said first and second rollers, unless said first and second rollers are axially displaced; and (f) cam follower means coupling said first and second rollers to said pusher member for actuating said pusher member to make or break one or more electrical connections between one or more of said electrical contacts at a predetermined pivot angle of said first and second rollers occurring when said first and second rollers have been axially displaced by said actuating member.

10. An electrical switch as set forth in claim 9 wherein said pusher member includes first and second projections extending therefrom in interlocked mating relation to respective first and second recesses in said respective first and second rollers for limiting the rotating of said first and second rollers in their undisplaced condition to a length of travel less than that necessary to affect the condition of said electrical contacts.

11. An electrical switch as set forth in claim 10 wherein said cam follower means comprises third and fourth projections extending from said pusher member in mating relation with respective third and fourth arcuate recesses formed in said respective first and second rollers such that as said first and second rollers rotate, said third and fourth projections follow said third and fourth recesses and linearly actuate said pusher member.

12. A keyed electrical switch comprising:

(a) a housing containing a slidably mounted, spring biased push rod operable to and fro in a straight line and carrying at least one electrical contact for engaging, in an extended position of said push rod, one or more electrical contacts mounted in said housing;

(b) at least one pivotably mounted roller mounted in drive connection with said push rod such that upon achieving a predetermined pivot angle of said push roller said rod will assume said extended position;

(c) said housing having an opening through which an actuating member adapted to rotate said roller may be inserted;

(d) means engageable by said actuating member for axially displacing said roller;

(e) means for limiting the rotation of said roller, unless said roller is axially displaced; and wherein (f) said roller is rotatable through said predetermined pivot angle only when axially displaced.

* * * * *

UNITED STATES PATENT AND TRADEMARK OFFICE

CERTIFICATE OF CORRECTION

PATENT NO. : 4,524,251

DATED : June 18, 1985

INVENTOR(S) : Siegfried Schulz

It is certified that error appears in the above-identified patent and that said Letters Patent are hereby corrected as shown below:

Column 3, Line 24, delete "actuating member."

Column 3, Line 37, "Switches" should read -- switch --.

Signed and Sealed this

*Twenty-second* Day of *October 1985*

[SEAL]

*Attest:*

DONALD J. QUIGG

*Attesting Officer*

*Commissioner of Patents and Trademarks—Designate*